United States Patent [19]

Bowers

[11] 4,427,378

[45] Jan. 24, 1984

[54] CLOSURE AND SEAL CONSTRUCTION FOR HIGH-PRESSURE OXIDATION FURNACE AND THE LIKE

[75] Inventor: Gerald M. Bowers, Boonville, Calif.

[73] Assignee: Atomel Corporation, Sunnyvale, Calif.

[21] Appl. No.: 363,062

[22] Filed: Mar. 29, 1982

[51] Int. Cl.[3] ..... F27D 1/18; F26B 25/00; F23M 7/00

[52] U.S. Cl. ..... 432/242; 34/242; 110/173 R; 432/250

[58] Field of Search ..... 432/242, 250; 34/242; 110/173 R, 176, 180, 181, 182

[56] References Cited

U.S. PATENT DOCUMENTS

| | | | |
|---|---|---|---|
| 3,144,035 | 8/1964 | Hablanian et al. | 34/242 |
| 3,751,219 | 8/1973 | Kitchel | 432/242 |
| 3,825,409 | 7/1974 | Longenecker | 432/250 |
| 4,167,915 | 9/1979 | Toole et al. | 118/708 |
| 4,278,422 | 7/1981 | Thompson | 432/253 |

*Primary Examiner*—John J. Camby

*Attorney, Agent, or Firm*—Manfred M. Warren; Robert B. Chickering; Glen R. Grunewald

[57] ABSTRACT

A closure and seal construction for a high-pressure oxidation furnace and the like having a quartz chamber and an integral quartz wall formed with an opening for receiving into the chamber material to be processed, the wall providing an annular surface surrounding the opening and being formed with an annular recess in the surface surrounding the opening; a combined cooling and sealing tube mounted in the recess and protruding slightly therefrom; a closure mounted for engagement with the tube and wall surface; and the tube having an elasticity responsive to a closing pressure to resiliently retract and provide simultaneous sealing engagement of the closure with the wall surface and tube.

3 Claims, 5 Drawing Figures

CLOSURE AND SEAL CONSTRUCTION FOR HIGH-PRESSURE OXIDATION FURNACE AND THE LIKE

BACKGROUND OF THE INVENTION

1. Field of Invention

The invention relates to apparatus used for the processing of silicon wafers, such as high pressure oxidation and chemical vapor deposition furnaces, and the like, for example see U.S. Pat. No. 4,167,915.

2. Description of Prior Art

In order to minimize contamination, furnaces of the character described usually perform their processing activities within a quartz chamber, typically an open ended quartz cylinder. These furnaces also typically use a stainless steel end cap arrangement to provide for inserting and removing the wafer load into and from the furnace chamber and to provide the necessary gas tight seal required for exclusion of air and containment of process gases. Sealing of the end caps is normally accomplished by means of an elastomeric seal, such as an O-ring or gasket, to seal a stainless steel assembly to a quartz flange fused to the end of a furnace tube. A further O-ring is commonly used to obtain a seal between a stainless steel door plate and a stainless steel flange, with the door plate being moveable to provide the necessary access to the interior of the furnace chamber.

In certain applications it is necessary to provide cooling for the elastomeric seals and the stainless steel parts to prevent degradation of the seals and also to prevent contamination resulting from out-gassing of the stainless steel. This cooling is usually effected by circulating water through passages in the stainless steel parts, an arrangement which is expensive and difficult to install and somewhat limited in effectiveness.

SUMMARY OF THE INVENTION

An object of the present invention is to provide in a furnace of the character described a closure and seal construction which may be simply and readily manufactured at modest cost; which will provide a highly effective seal; and will at the same time fully protect the work being processed against contaminating out-gassing of elastomeric and structural members forming the closure and seal.

Another feature of the present invention is the elimination of all exposed metal parts in areas where their heating and out-gassing will produce contamination.

Still another and important feature of the present invention is the obtaining of water cooling of critical, engaged, quartz parts, which has heretofore been most difficult to obtain although a much sought after objective.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
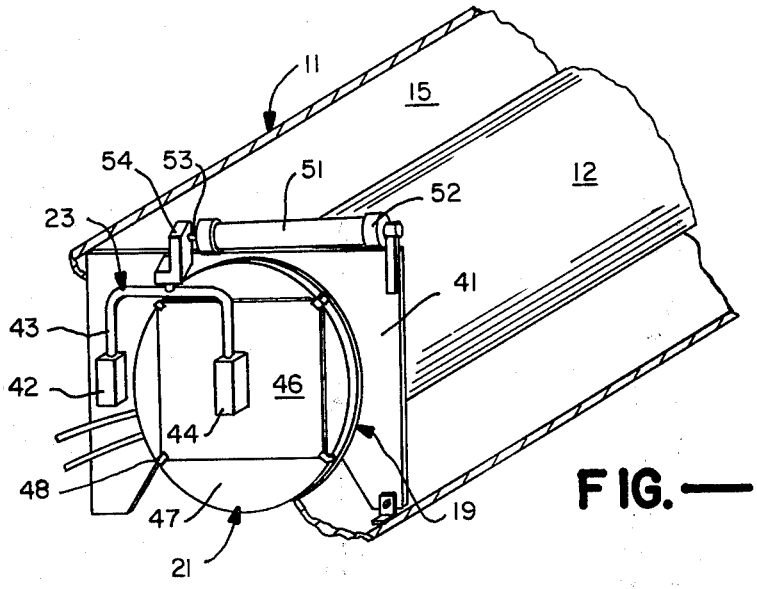
FIG. 1 is a fragmentary prospective view of a closure and seal construction for a high pressure oxidation furnace and the like, constructed in accordance with the present invention.

The closure and seal construction of the present invention is particularly adapted for use on a high pressure oxidation furnace 11 of the type generally illustrated and described in U.S. Pat. No. 4,167,915 and which has as one of its principal components a cylinderical quartz tube 12 providing a quartz chamber 13 within which silicone wafers are processed by well-known techniques in the production of integrated circuits on silicone chips. Quartz tube 12 is mounted within a pressure chamber 15 permitting equalization, or at least reduction to an acceptable amount, of a pressure differential across the rather fragile wall of the tube. Typically the external pressure chamber 15 is maintained at a pressure of about one atmosphere greater than the interior pressure in chamber 13. For other structural and functional details of the furnace, reference is made to U.S. Pat. No. 4,167,915.

One end of tube 12 is open, see opening 14, for the introduction and removal of silicone wafers into and from chamber 13. Opening 14 must be closed for carrying out the high pressure oxidation process, and the present invention is concerned with the structure for effecting such closure.

Figure 2:
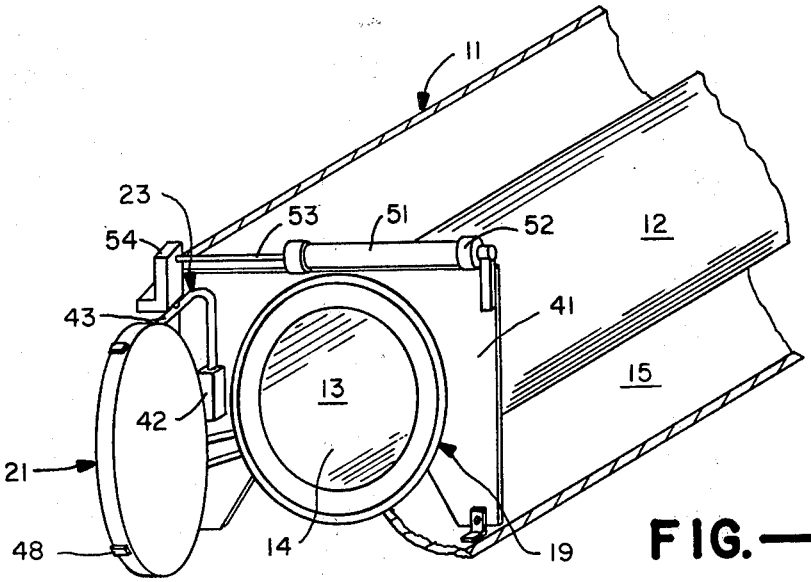
FIG. 2 is a view similar to FIG. 1 but showing the parts in a different position.
Figure 4:
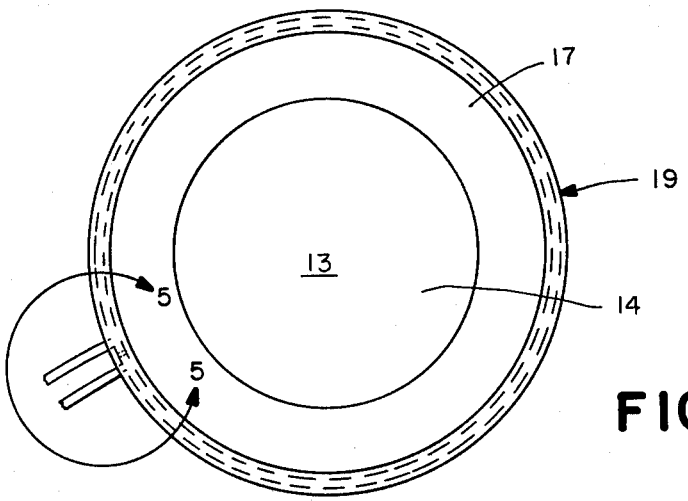
FIG. 4 is a front elevation of a portion of the structure taken substantially on the plane of line 4—4 of FIG. 3.
Figure 3:
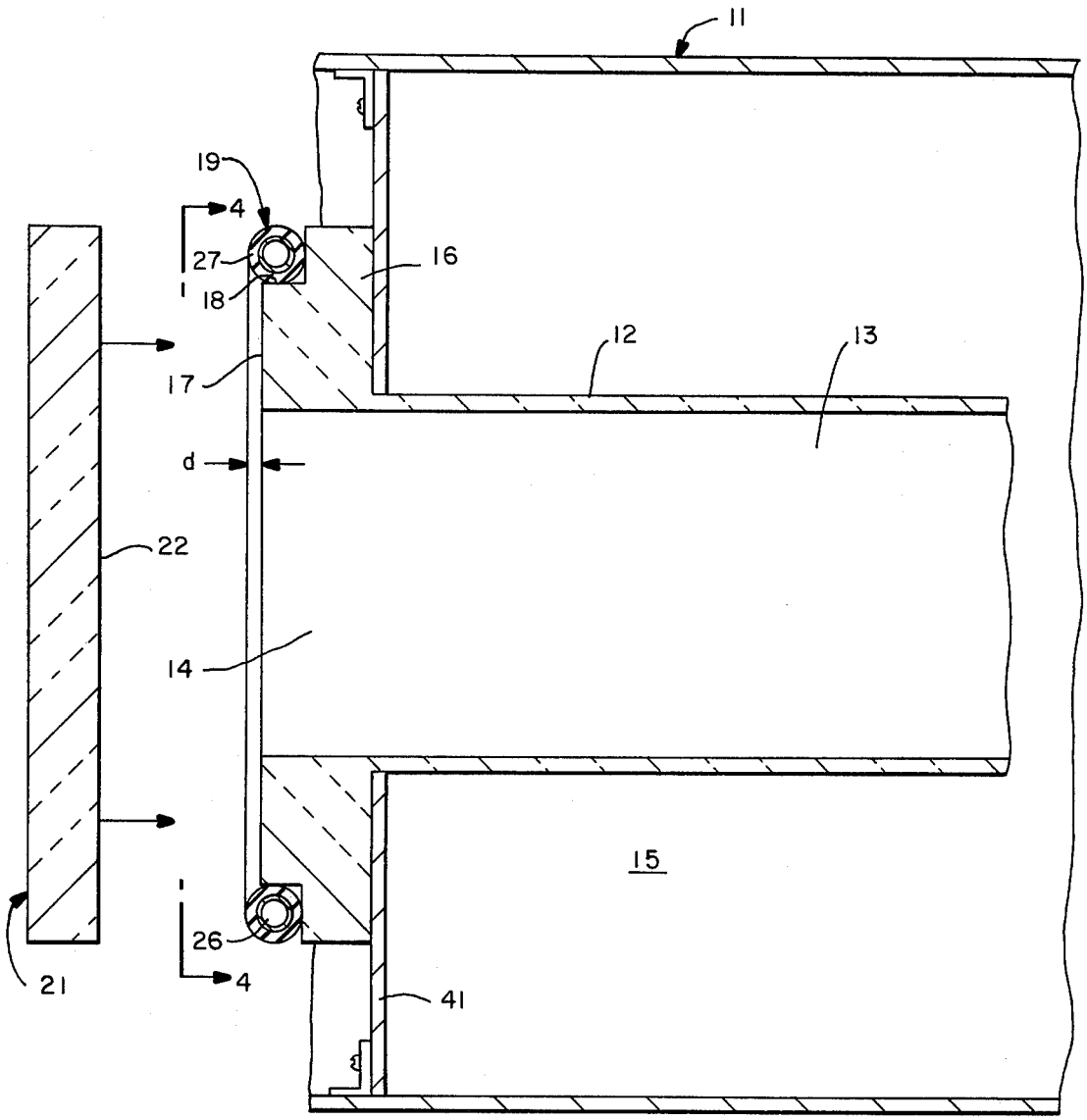
FIG. 3 is an enlarged fragmentary cross-sectional view of a portion of the structure with parts of the closing mechanism removed.

As will be best seen in FIGS. 2, 3 and 4, quartz tube 12 is formed with an integral end wall or flange 16 providing a flat annular surface 17 surrounding opening 14, and surface 17 is formed with an annular recess 18. In accordance with the present invention, a coolant and sealing tube 19 is mounted in recess 18 and has a diameter causing the tube to protrude slightly from surface 17 by a small distance noted by dimension d in FIG. 3. Tube 19 is provided with inlet and outlet connections 36 and 37 adapted for connection to a source of coolant and for conduction of coolant through the tube. Mounted for movement to and from surface 17 and tube 19 is closure plate 21 which in its closed position effects a covering and closing of opening 14. In accordance with the present invention, a closing pressure is applied to plate 21 which cofunctions with the elasticity of tube 19 causing the latter to resiliently retract and provide simultaneous sealing engagement of the interior surface 22 of the closure with surface 17 and tube 19. An operating pressure may be obtained in part from the mounting means 23 for the closure and in part by the pressure differential across the closure applied by the relatively higher pressure in the surrounding pressure chamber.

Figure 5:
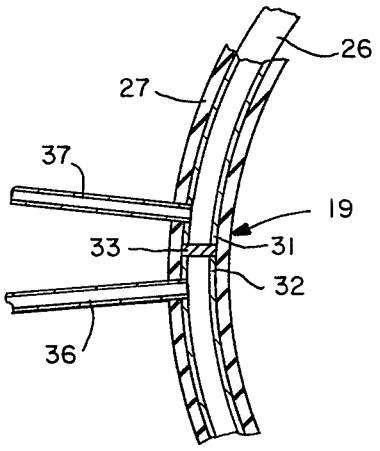
FIG. 5 is a fragmentary cross-sectional view on a further enlarged scale of a portion of the device indicated by line 5—5 of FIG. 4.

Preferably, and as here shown, tube 19 is formed as a composite or laiminated structure with an interior metal tube 26, such as stainless steel to provide thermal conductivity, and an elastomeric coating 27 such as silicone rubber. The finished cross-section diameter of the O-ring thus formed is chosen to be about 0.012 inches to 0.018 inches larger than the depth of recess 18, measured axially of tube 12. As a further feature of the present invention surface 17 and wall 16 are provided by a quartz flange welded or fused to the end of quartz tube 12; the flange being formed around its periphery and at surface 17 with recess 18; and the annular surface 17 interiorally of the recess is ground flat and optically polished. Similarly, door plate 21 is made of clear fused quartz and also has its interior surface 22 ground flat and optically polished so as to provide a sealed contact with surface 17. The O-ring tube 19 may be conveniently formed by rolling the metal tube 26 in a circle and welding the opposite ends 31 and 32 of the tube to a divider disc 33, see FIG. 5. Inlet an outlet tubes 36 and 37 are here welded on each side of divider 33 to provide water coolant circulation as above noted.

Any suitable mounting and actuation structure may be used for juxtaposing closure 21 to annular surface 17 and tube 19 in covering relation to opening 14 and to apply at least an initial closing pressure urging closure 21 toward surface 17 and tube 19. As here shown, an end plate 41 adjacent flange 16 carries a hinged joint 42 for one end of an arm 43 having its opposite end connected a hinged joint 44 which is secured to a plate 46 fastened, as by fingers 48, to the exterior side 47 of closure 21, the hinged structure thus formed providing for the swinging of closure plate 21 from an open position as illustrated in FIG. 2 to a closed position across the end of the tube as illustrated in FIG. 1. Opening and closing of the closure plate is preferably effected by automated means 51 which is at the same time capable of supplying a requisite closing force. Any motorized type of drive may be used. As here shown, motorized actuation is obtained by a hydraulic or pneumatic cylinder 51 secured at one end 52 to mounting plate 41 and having a piston driven shaft 53 at its opposite end connected to a bracket 54 having a swivel mounting on arm 43. Accordingly extension of shaft 53, as seen in FIG. 2 will cause closure plate 21 to open, and retraction of shaft 53 into cylinder 51 will cause the closure plate to swing into abutment with the flange surface 17 and ring 19. Perferably the closure mechanism is capable of producing a closing force on closure plate 21 in the order of about 25 to 75 pounds. In the operation of a high pressure oxidation furnace, the exterior pressure chamber will maintain a pressure differential across the closure door of approximately one atmosphere which, in a typical size furnace having a 135 mm furnace tube, will place an end thrust of approxmately 325 pounds on the door plate 21. The combination of 25 to 75 pounds preload and the 325 pounds end thrust squeezes the elastomeric O-ring, compressing it so that the ground and polished faces 17 and 22 meet. The basic seal is effected by the fit between these surfaces, and the water cooled elastomeric O-ring serves as a back-up. Thereafter, the furnace tube and surrounding pressure shell are pressurized to operating pressure with the one atmosphere pressure differential being maintained. At the end of the process the reaction chamber and surrounding pressure chamber are simultaneously vented and allowed to equalize to room pressure. The door plate 21 may then be opened by actuator 51.

While the apparatus of the present invention has been described in connection with a high pressure oxidation furnace, it is equally applicable to other similar types of apparatus such as a low pressure chemical vapor deposition furnace. In such instance the reaction chamber is evacuated and the processing done at a reduced pressure which produces the same pressure differential and end thrust as above-described.

In the preferred embodiment of the invention, as here shown, the reaction chamber 13 is of cylinderical form and sealing surface 17 comprises a flat annulus substantially concentric to the longitudinal axis of chamber 13 and is disposed in a plane substantially perpendicular to such axis. Also, as will be noted, recess 18 is formed to open in an axial direction and is preferably positioned at the outer periphery of the annulus confronting closure plate 21. The protrusion of O-ring tube 19 from the recess is a fraction of the thickness of the surrounding elastomeric coating 27 so that the ensuing compression of the O-ring will be effected by the compression of the elastomeric coating. A high temperature resisting silicone elastomer is suggested for this coating. Thus a dual seal of high quality is provided, first by the engagement of the opticaly polished surfaces and secondly by the compression of the O-ring tube.

The structure as disclosed minimizes the exposure of materials other than quartz to the gas stream and furnace interior and especially eliminates the exposure of problem causing materials such as stainless steel. At the same time stainless steel is the material of choice for the interior of tube 19; and the water cooling of this part effectively cools the elastomeric seal and adjacent parts in a simple, direct and trouble-free manner.

What is claimed is:

1. A closure and seal construction for a high pressure oxidation furnace and the like having a quartz chamber and integral quartz wall formed with an opening for receiving into said chamber of material to be processed, said wall being formed with an annular recess surrounding said opening;

a tube mounted in said recess and comprising an interior metallic wall providing thermal conductivity and an elastomeric coating providing elasticity and dimensioned for protrusion of said coating from said recess and being adapted for connection to a source of coolant and for conduction of said coolant therethrough;

a closure and mounting means therefor juxtaposing said closure and wall and tube in covering relation to said opening and applying a closing pressure urging said closure toward said wall and tube, said closure having a flat annular surface confronting said wall and engageable with and compressing said coating; and said coating being responsive to said clsoing pressure to seal said opening.

2. The apparatus of claim 1, said chamber being of generally cylindrical form and said wall having an annular planar surface disposed in a plane substantially perpendicular to the axis of said chamber, and said recess being formed to open in an axial direction; and said closure surface being formed to simultaneously compress said elastomeric coating and to mate with said wall surface; said wall and closure surfaces being polished to effect sealing contact.

3. The apparatus of claim 2, said wall comprising an annulus substantially concentric to said axis and said recess being positioned at the outer periphery of said annulus confronting said closure.

* * * * *